US006416275B1

(12) United States Patent
Itzel et al.

(10) Patent No.: US 6,416,275 B1
(45) Date of Patent: Jul. 9, 2002

(54) RECESSED IMPINGEMENT INSERT METERING PLATE FOR GAS TURBINE NOZZLES

(76) Inventors: Gary Michael Itzel, 218 Quail Ridge Dr., Greenville, SC (US) 29680; Steven Sebastian Burdgick, 7006 Kevin La., Schenectady, NY (US) 12303

( * ) Notice: Subject to any disclaimer, the term of this patent is extended or adjusted under 35 U.S.C. 154(b) by 0 days.

(21) Appl. No.: 09/681,738

(22) Filed: May 30, 2001

(51) Int. Cl.[7] ..... F01D 9/04

(52) U.S. Cl. ..... 415/116; 416/115

(58) Field of Search ..... 415/115, 116

(56) References Cited

U.S. PATENT DOCUMENTS

| | | | | | |
|---|---|---|---|---|---|
| 4,252,501 | A | * | 2/1981 | Peill | 415/115 |
| 4,257,734 | A | * | 3/1981 | Guy et al. | 415/115 |
| 5,145,315 | A | * | 9/1992 | North et al. | 415/115 |
| 5,511,937 | A | * | 4/1996 | Papageorgiou | 415/115 |
| 5,609,466 | A | * | 3/1997 | North et al. | 415/115 |
| 5,634,766 | A | * | 6/1997 | Cunha et al. | 415/115 |
| 5,743,708 | A | * | 4/1998 | Cunha et al. | 415/115 |
| 5,762,471 | A | | 6/1998 | Cunha | 415/115 |
| 6,089,822 | A | * | 7/2000 | Fukuno | 415/115 |
| 6,183,192 | B1 | * | 2/2001 | Tresslet et al. | 415/115 |
| 6,186,741 | B1 | | 2/2001 | Webb | |
| 6,200,087 | B1 | * | 3/2001 | Tung et al. | 415/115 |
| 6,283,708 | B1 | * | 9/2001 | Zelesky | 416/97 R |

OTHER PUBLICATIONS

"39 th GE Turbine State–of–the–Art Technology Seminar", Tab 1, ""F" Technology –the First Half–Million Operating Hours", H.E. Miller, Aug. 1996.

"39th GE Turbine State–of–the–Art Technology Seminar", Tab 2, "GE Heavy–Duty Gas Turbine Performance Characteristics", F.J. Brooks, Aug. 1996.

"39th GE Turbine State–of–the–Art Technology Seminar", Tab 3, "9EC 50Hz 170–MW Class Gas Turbine", A. S. Arrao, Aug. 1996.

"39th GE Turbine State–of–the–Art Technology Seminar", Tab 4, "MWS6001FA –An Advanced Technology 70–MW Class 50/60 Hz Gas Turbine", Ramachandran et al., Aug. 1996.

"39th GE Turbine State–of–the–Art Technology Seminar", Tab 5, "Turbomachinery Technology Advances at Nuovo Pignone", Benvenuti et al., Aug. 1996.

"39th GE Turbine State–of–the–Art Technology Seminar", Tab 6, "GE Aeroderivative Gas Turbines –Design and Operating Features", M.W. Horner, Aug. 1996.

"39th GE Turbine State–of–the–Art Technology Seminar", Tab 7, "Advance Gas Turbine Materials and Coatings", P. W. Schilke, Aug. 1996.

"39th GE Turbine State–of–the–Art Technology Seminar", Tab 8, "Dry Low $NO_x$ Combustion Systems for GE Heavy–Duty Turbines", L.B. Davis, Aug. 1996.

"39th GE Turbine State–of–the–Art Technology Seminar", Tab 9, "GE Gas Turbine Combustion Flexibilty", M. A. Davi, Aug. 1996.

"39th GE Turbine State–of–the–Art Technology Seminar", Tab 10, "Gas Fuel Clean–Up System Design Considerations for GE Heavy–Duty Gas Turbines", C. Wilkes, Aug. 1996.

(List continued on next page.)

*Primary Examiner*—John E. Ryznic

(57) ABSTRACT

An impingement insert sleeve is provided that is adapted to be disposed in a coolant cavity defined through a stator vane. The insert has a generally open inlet end and first and second diametrically opposed, perforated side walls. A metering plate having at least one opening defined therethrough for coolant flow is mounted to the side walls to generally transverse a longitudinal axis of the insert, and is disposed downstream from said inlet end. The metering plate improves flow distribution while reducing ballooning stresses within the insert and allowing for a more flexible insert attachment.

12 Claims, 4 Drawing Sheets

OTHER PUBLICATIONS

"39th GE Turbine State–of–the–Art Technology Seminar", Tab 11, "Integrated Control Systems for Advanced Combined Cycles", Chu et al., Aug. 1996.
"39th GE Turbine State–of–the–Art Technology Seminar", Tab 12, "Power Systems for the 21st Century "H" Has Turbine Combined Cycles", Paul et al., Aug. 1996.
"39th GE Turbine State–of–the–Art Technology Seminar", Tab 13, "Clean Coal and Heavy Oil Technologies for Gas Turbines", D. M. Todd, Aug. 1996.
"39th GE Turbine State–of–the–Art Technology Seminar", Tab 14, "Gas Turbine Conversions, Modifications and Uprates Technology", Stuck et al., Aug. 1996.
"39th GE Turbine State–of–the–Art Technology Seminar", Tab 15, "Performance and Reliability Improvements for Heavy–Duty Gas Turbines, "J. R. Johnston, Aug. 1996.
"39th GE Turbine State–of–the–Art Technology Seminar", Tab 16, "Gas Turbine Repair Technology", Crimi et al, Aug. 1996.
"39th GE Turbine State–of–the–Art Technology Seminar", Tab 17, "Heavy Duty Turbine Operating & Maintenance Considerations", R. F. Hoeft, Aug. 1996.
"39th GE Turbine State–of–the–Art Technology Seminar", Tab 18, "Gas Turbine Performance Monitoring and Testing", Schmitt et al., Aug. 1996.
"39th GE Turbine State–of–the–Art Technology Seminar", Tab 19, "Monitoring Service Delivery System and Diagnostics", Madej et al., Aug. 1996.
"39th GE Turbine State–of–the–Art Technology Seminar", Tab 20, "Steam Turbines for Large Power Applications", Reinker et al., Aug. 1996.
"39th GE Turbine State–of–the–Art Technology Seminar", Tab 21, "Steam Turbines for Ultrasupercritical Power Plants", Retzlaff et al., Aug. 1996.
"39th GE Turbine State–of–the–Art Technology Seminar", Tab 22, "Steam Turbine Sustained Efficiency", P. Schofield, Aug. 1996.
"39th GE Turbine State–of–the–Art Technology Seminar", Tab 23, "Recent Advances in Steam Turbines for Industrial and Cogeneration Applications", Leger et al., Aug. 1996.
"39th GE Turbine State–of–the–Art Technology Seminar", Tab 24, "Mechanical Drive Steam Turbines", D. R. Leger, Aug. 1996.
"39th GE Turbine State–of–the–Art Technology Seminar", Tab 25, "Steam Turbines for STAG™ Combined Cycle Power Systems", M. Boss, Aug. 1996.
"39th GE Turbine State–of–the–Art Technology Seminar", Tab 26, "Cogeneration Application Considerations", Fisk et al., Aug. 1996.
"39th GE Turbine State–of–the–Art Technology Seminar", Tab 27, "Performance and Economic Considerations of Repowering Steam Power Plants",Stoll et al., Aug. 1996.
"39th GE Turbine State–of–the–Art Technology Seminar", Tab 28, "High–Power Density™ Steam Turbine Design Evolution", J. H. Moore, Aug. 1996.
"39th GE Turbine State–of–the–Art Technology Seminar", Tab 29, "Advances in Steam Path Technologies", Cofer, IV, et al., Aug. 1996.
"39th GE Turbine State–of–the–Art Technology Seminar", Tab 30, "Upgradable Opportunities for Steam Turbines", D. R. Dreier, Jr., Aug. 1996.
"39th GE Turbine State–of–the–Art Technology Seminar", Tab 31, "Uprate Options for Industrial Turbines", R. C. Beck, Aug. 1996.
"39th GE Turbine State–of–the–Art Technology Seminar", Tab 32, "Thermal Performace Evaluation and Assessment of Steam Turbine Units", P. Albert, Aug. 1996.
"39th GE Turbine State–of–the–Art Technology Seminar", Tab 33, "Advances in Welding Repair Technology" J. F. Nolan, Aug. 1996.
"39th GE Turbine State–of–the–Art Technology Seminar", Tab 34, "Operation and Maintenance Strategies to Enhance Plant Profitability", MacGillivray et al., Aug. 1996.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et al., Aug. 1996.
"39th GE Turbine State–of–the–Art Technology Seminar", Tab 37, "GE Combined Cycle Product Line and Performance", Chase et al., Aug. 1996.
"39th GE Turbine State–of–the–Art Technology Seminar", Tab 38, "GE Combines Cycle Experience", Maslak et al., Aug. 1996.
"39th GE Turbine State–of–the–Art Technology Seminar", Tab 39, "Single–Shaft Combined Cycle Power Generation Systems", Tomlinson et al., Aug. 1996.
"Advanced Turbine System Program–Conceptual Design and Product Development", Annual Report, Sep. 1, 1994–Aug. 31, 1995.
"Advanced Turbine Systems (ATS Program) Conceptual Design and Product Development", Final Technical Progress Report, vol. 2–Industrial Machine, Mar. 31, 1997, Morgantown, WV.
"Advanced Turbine Systems (ATS Program), Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993–Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.
"Environmental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report Numbers DE–FC21–95MC31176—11.
"Exhibit panels used at 1995 product introduction at PowerGen Europe".
"Extensive Testing Program Validates High Efficiency, reliability of GE's Advanced "H" Gas Turbine Technology", Press Information, Press Release, 96–NR14, Jun. 26, 1996, H Technology Tests/pp. 1–4.
"Extensive Testing Program Validates High Efficiency, Reliability of GE's Advanced "H" Gas Turbine Technology", GE Introduces Advanced Gas Turbine Technology Platform: First to Reach 60% Combined Cycle Power Plant Efficiency, Press Information, Press Release, Power–Gen Europe '95, 95–NRR15, Advanced Technology Introduction/pp. 1–6.

"Gas, Steam Turbine Work as Single Unit in GE's Advanced H Technology Combines–Cycle System", Press Information, Press Release, 95–NR18, May 16, 1995, Advanced Technology Introduction/pp. 1–3.
"GE Breaks 60% Net Efficiency Barrier"paper, 4 pages.
"GE Businesses Share Technologies and Experts to Develop State–Of–The–Art Products", Press Information, Press Release 95–NR10, May 16, 1995, GE Technology Transfer/ pp. 1–3.
"General Electric ATS Program Technical Review, Phase 2 Activities", T. Chance et al., pp. 1–4.
"General Electric's DOE/ATS H Gas Turbine Development" Advanced Turbine Systems Annual Review Meeting, Nov. 7–8, 1996, Washington, D.C., Publication Release.
"H Technology Commercialization", 1998 MarComm Activity Recommendation, Mar., 1998.
"H Technology", Jon Ebacher, VP, Power Gen Technology, May 8, 1998.
"H Testing Process", Jon Ebacher, VP, Power Gen Technology, May 8, 1998.
"Heavy–Duty & Aeroderivative Products" Gas Turbines, Brochure, 1998.
"MS7001H/MS9001H Gas Turbine, gepower.com website for PowerGen Europe" Jun. 1–3 going public Jun. 15, (1995).
"New Steam Cooling System is a Key to 60% Efficiency for GE "H" Technology Combines–Cycle Systems", Press Information, Press Release, 95–NRR16, May 16, 1995, H Technology/pp. 1–3.
"Overview of GE's H Gas Turbine Combined Cycle", Jul. 1, 1995 to Dec. 31, 1997.
"Power Systems for the 21$^{st}$ Century–"H " Gas Turbine Combines Cycles", Thomas C. Paul et al., Report,.
"Power–Gen '96 Europe", Conference Programme, Budapest, Hungary, Jun. 26–28, 1996.
"Power–Gen International", 1998 Show Guide, Dec. 9–11, 1998, Orange County Convention Center, Orlando, Florida.
"Press Coverage following 1995 product announcement"; various newspaper clippings relating to improved generator.
"Proceedings of the Advanced Turbine Systems Annual Program Review Meeting", vol. I, "Industrial Advanced Turbine Systems Program Overview", D. W. Esbeck, pp. 3–13, Oct., 1995.
"Proceedings of the Advanced Turbine Systems Annual Program Review Meeting", vol. I, "H Gas Turbine Combined Cycle", J. Corman, pp. 14–21, Oct., 1995.
"Proceedings of the Advanced Turbine Systems Annual Program Review Meeting", vol. I, "Overview of Westinghouse's Advanced Turbine Systems Program", Bannister et al., pp. 22–30, Oct. 1995.
"Proceedings of the Advanced Turbine Systems Annual Program Review Meeting", vol I, "Allison Engine ATS Program Technical Review", D. Mukavetz, pp. 31–42, Oct., 1995.
"Proceedings of the Advanced Turbine Systems Annual Program Review Meeting", vol. I, "Advanced Turbine Systems Program Industrial System Concept Development", S. Gates, pp. 43–63, Oct., 1995.
"Proceedings of the Advanced Turbine Systems Annual Program Review Meeting", vol. I, "Advanced Turbine System Program Phase 2 Cycle Selection", Latcovich, Jr., pp. 64–69, Oct., 1995.
"Proceedings of the Advanced Turbine Systems Annual Program Review Meeting", vol. I, "General Electric ATS Program Technical Review Phase 2 Activities", Chance et al., pp. 70–74, Oct., 1995.
"Proceedings of the Advanced Turbine Systems Annual Program Review Meeting", vol. I, "Technical Review of Westinghouse's Advanced Turbine Systems Program", Daikunchak et al., pp. 75–86, Oct., 1995.
"Proceedings of the Advanced Turbine Systems Annual Program Review Meeting", vol I, "Advanced Combustion Turbines and Cycles: An EPRI Perspective", Touchton et al., pp. 87–88, Oct., 1995.
"Proceedings of the Advanced Turbine Systems Annual Program Review Meeting", vol. I, "Advanced Turbine Systems Annual Program Review", William E. Koop, pp. 89–92, Oct., 1995.
"Proceedings of the Advanced Turbine Systems Annual Program Review Meeting", vol. I, "The AGTSR Consortium: An Update", Fant et al., pp. 93–102, Oct., 1995.
"Proceedings of the Advanced Turbine Systems Annual Program Review Meeting", vol. I, "Overview of Allison/ AGTSR Interactions", Sy A. Ali, pp. 103–106, Oct., 1995.
"Proceedings of the Advanced Turbine Systems Annual Program Review Meeting", vol. I, "Design Factors for Stable Lean Premix Combustion", Richards et al., pp. 107–113, Oct., 1995.
"Proceedings of the Advanced Turbine Systems Annual Program Review Meeting", vol. I, "Ceramic Stationary as Turbine", M. van Roode, pp. 114–147, Oct., 1995.
"Proceedings of the Advanced Turbine Systems Annual Program Review Meeting", vol. I, "DOE/Allison Ceramic Vane Effort", Wenglarz et al., pp. 148–151, Oct., 1995.
"Proceedings of the Advanced Turbine Systems Annual Program Review Meeting", vol. I, "Materials/Manufacturing Element of the Advanced Turbine Systems Program", Karnitz et al., pp. 152–160, Oct., 1995.
"Proceedings of the Advanced Turbine Systems Annual Program Review Meeting", vol. I, "Land–Based Turbine Casting Initiative", Mueller et al., pp. 161–170, Oct., 1995.
"Proceedings of the Advanced Turbine Systems Annual Program Review Meeting", vol. I, "Turbine Airfoil Manufacturing Technology", Kortovich, pp. 171–181, Oct., 1995.
"Proceedings of the Advanced Turbine Systems Annual Program Review Meeting", vol. I, "Pratt & Whitney Thermal Barrier Coatings", Bornstein et al., pp. 182–193, Oct., 1995.
"Proceedings of the Advanced Turbine Systems Annual Program Review Meeting", vol. I, "Westinhouse Thermal Barrier Coatings", Goedjen et al., pp. 194–199, Oct., 1995.
"Proceedings of the Advanced Turbine Systems Annual Program Review Meeting", vol. I, "High Performance Steam Development", Duffy et al., pp. 200–220, Oct., 1995.
"Proceedings of the Advanced Turbine Systems Annual Program Review Meeting", vol. II, "Lean Premixed Combustion Stablized by Radiation Feedback and heterogeneous Catalysis", Dibble et al., pp. 221–232, Oct., 1995.
"Proceedings of the Advanced Turbine Systems Annual Program Review Meeting", vol. II, Rayleigh/Raman/LIF Measurements in a Turbulent Lean Premixed Combustor, Nandula et al. pp. 233–248, Oct., 1995.
"Proceedings of the Advanced Turbine Systems Annual Program Review Meeting", vol. II, "Lean Premixed Flames for Low $No_x$ Combustors", Sojka et al., pp. 249–275, Oct., 1995.

"Proceedings of the Advanced Turbine Systems Annual Program Review Meeting", vol. II, "Functionally Gradient Materials for Thermal Barrier Coatings in Advanced Gas Turbine Systems", Banovic et al., pp. 276–280, Oct., 1995.

"Proceedings of the Advanced Turbine Systems Annual Program Review Meeting", vol. II, "Advanced Turbine Cooling, Heat Transfer, and Aerodynamic Studies", Han et al., pp. 281–309, Oct., 1995.

"Proceedings of the Advanced Turbine Systems Annual Program Review Meeting", vol. II, "Life Prediction of Advanced Materials for Gas Turbine Application", Zamrik et al., pp. 310–327, Oct., 1995.

"Proceedings of the Advanced Turbine Systems Annual Program Review Meeting", vol. II, "Advanced Combustion Technologies for Gas Turbine Power Plants", Vandsburger et al., pp. 328–352, Oct., 1995.

"Proceedings of the Advanced Turbine Systems Annual Program Review Meeting", vol. II, "Combustion Modeling in Advanced Gas Turbine Systems", Smoot et al., pp. 353–370, Oct., 1995.

"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. pp. 371–390, Oct., 1995.

"Proceedings of the Advanced Turbine Systems Annual Program Review Meeting", vol. II, "Rotational Effects on Turbine Blade Cooling", Govatzidakia et al., pp. 391–392, Oct.,1995.

"Proceedings of the Advanced Turbine Systems Annual Program Review Meeting", vol. II, "Manifold Methods for Methane Combustion", Yang et al., pp. 393–409, Oct., 1995.

"Proceedings of the Advanced Turbine Systems Annual Program Review Meeting", vol. II, "Advanced Multistage Turbine Blade Aerodynamics, Performance, Cooling, and Heat Transfer", Fleeter et al., pp. 410–414, Oct., 1995.

"Proceedings of the Advanced Turbine Systems Annual Program Review Meeting", vol. II, "The Role of Reactant Unmixedness, Strain Rate, and Length Scale on Premixed Combustor Performance", Samuelsen et al., pp. 415–422, Oct., 1995.

"Proceedings of the Advanced Turbine Systems Annual Program Review Meeting", vol. II, "Experimental and Computational Studies of Film Cooling With Compound Angle Injection", Goldstein et al., pp. 423–451, Oct., 1995.

"Proceedings of the Advanced Turbine Systems Annual Program Review Meeting", vol. II, "Compatibility of Gas Turbine Materials with Steam Cooling", Desai et al. pp. 452–464, Oct., 1995.

"Proceedings of the Advanced Turbine Systems Annual Program Review Meeting", vol. II, "Use of a Laser–Induced Fluorescence Thermal Imaging System for Film Cooling Heat Transfer Measurement", M. K. Chyu, pp. 465–473, Oct., 1995.

"Proceedings of the Advanced Turbine Systems Annual Program Review Meeting", vol. II, Effects of Geometry on Slot–Jet Film Cooling Performance, Hyams et al., pp. 474–496 Oct., 1995.

"Proceedings of the Advanced Turbine Systems Annual Program Review Meeting", vol. II, "Steam as Turbine Blade Coolant: Experimental Data Generation", Wilmsen et al., pp. 497–505, Oct., 1995.

"Proceedings of the Advanced Turbine Systems Annual Program Review Meeting", vol. II, "Combustion Chemical Vapor Deposited Coatings for Thermal Barrier Coating Systems", Hampikian et al., pp. 506–515, Oct., 1995.

"Proceedings of the Advanced Turbine Systems Annual Program Review Meeting", vol. II, "Premixed Burner Experiments: Geometry, Mixing, and Flame Structure Issues", Gupta et al., pp. 516–528, Oct., 1995.

"Proceedings of the Advanced Turbine Systems Annual Program Review Meeting", vol. II, "Intercooler Flow Path for Gas Turbines: CFD Design and Experiments", Agrawal et al., pp. 529–538, Oct., 1995.

"Proceedings of the Advanced Turbine Systems Annual Program Review Meeting", vol. II, "Bond Strength and Stress Measurements in Thermal Barrier Coatings", Gell et al., pp. 539–549, Oct., 1995.

"Proceedings of the Advanced Turbine Systems Annual Program Review Meeting", vol. II, "Active Control of Combustion Instabilities in Low $NO_x$ Gas Turbines", Zinn et al., pp. 550–551, Oct., 1995.

"Proceedings of the Advanced Turbine Systems Annual Program Review Meeting", vol. II, "Combustion Instability Modeling and Analysis", Santoro et al., pp. 552–559, Oct., 1995.

"Proceedings of the Advanced Turbine Systems Annual Program Review Meeting", vol. II, "Flow and Heat Transfer in Gas Turbine Disk Cavities Subject to Nonuniform External Pressure Field", Roy et al., pp. 560–565, Oct., 1995.

"Proceedings of the Advanced Turbine Systems Annual Program Review Meeting", vol. II, "Heat Pipe Turbine Vane Cooling", Langston et al., pp. 566–572, Oct., 1995.

"Proceedings of the Advanced Turbine Systems Annual Program Review Meeting", vol. II, "Improved Modeling Techniques for Turbomachinery Flow Fields", Lakshminarayana et al., pp. 573–581, Oct., 1995.

"Proceedings of the Advanced Turbine Systems Annual Program Review Meeting", vol. II, "Advanced 3D Inverse Method for Designing Turbomachine Blades", T. Dang, p. 582, Oct., 1995.

"Proceedings of the Advanced Turbine Systems Annual Program Review Meeting","ATS and the Industries of the Future", Denise Swink, p. 1, Nov., 1996.

"Proceedings of the Advanced Turbine Systems Annual Program Review Meeting","Gas Turbine Association Agenda", William H. Day, pp. 3–16, Nov., 1996.

"Proceedings of the Advanced Turbine Systems Annual Program Review Meeting","Power Needs in the Chemical Industry", Keith Davidson, pp. 17–26, Nov., 1996

"Proceedings of the Advanced Turbine Systems Annual Program Review Meeting","Advanced Turbine Systems Program Overview", David Esbeck, pp. 27–34, Nov., 1996.

"Proceedings of the Advanced Turbine Systems Annual Program Review Meeting","Westinghouse's Advanced Turbine Systems Program", Gerard McQuiggan, pp. 35–48, Nov., 1996.

"Proceedings of the Advanced Turbine Systems Annual Program Review Meeting","Overview of GE's H Gas Turbine Combined Cycle", Cook et al., pp. 49–72, Nov., 1996.

"Proceedings of the Advanced Turbine Systems Annual Program Review Meeting","Allison Advanced Simple Cycle Gas Turbine System", William D. Weisbrod, pp. 73–94, Nov., 1996.

"Proceedings of the Advanced Turbine Systems Annual Program Review Meeting","The AGTSR Industry–University Consortium", Lawrence P. Golan, pp. 95–110, Nov., 1996.
"Proceedings of the Advanced Turbine Systems Annual Program Review Meeting","$NO_x$ and CO Emissions Models for Gas–Fired Lean–Premixed Combustion Turbines", A. Mellor, pp. 111–112, Nov., 1996.
"Proceedings of the Advanced Turbine Systems Annual Program Review Meeting","Methodologies for Active Mixing and Combustion Control", Uri Vandsburger, pp. 123–156, Nov., 1996.
"Proceedings of the Advanced Turbine Systems Annual Program Review Meeting","Combustion Modeling in Advanced Gas Turbine Systems", Paul O. Hedman, pp. 157–180, Nov., 19967.
"Proceedings of the Advanced Turbine Systems Annual Program Review Meeting","Manifold Methods for Methane Combustion", Stephen B. Pope, pp. 181–188, Nov., 1996.
"Proceedings of the Advanced Turbine Systems Annual Program Review Meeting","The Role of Reactant Unmixedness, Strain Rate, and Length Scale on Premixed Combustor Performance", Scott Samuelsen, pp. 189–210, Nov., 1996.
"Proceedings of the Advanced Turbine Systems Annual Program Review Meeting","Effect of Swirl and Momentum Distribution on Temperature Distribution in Premixed Flames", Ashwani K. Gupta, pp. 211–232, Nov., 1996.
"Proceedings of the Advanced Turbine Systems Annual Program Review Meeting","Combustion Instability Studies Application to Land–Based Gas Turbine Combustors", Robert J. Santoro, pp. 233–252.
"Proceedings of the Advanced Turbine Systems Annual Program Review Meeting", Active Control of Combustion Instabilities in Low $NO_x$ Turbines, Ben T. Zinn, pp. 253–264, Nov., 1996.
"Proceedings of the Advanced Turbine Systems Annual Program Review Meeting","Life Prediction of Advanced Materials for Gas Turbine Application," Sam Y. Zamrick, pp. 265–274, Nov., 1996.
"Proceedings of the Advanced Turbine Systems Annual Program Review Meeting","Combustion Chemical Vapor Deposited Coatings for Thermal Barrier Coating Systems", W. Brent Carter, pp. 275–290, Nov., 1996.
"Proceedings of the Advanced Turbine Systems Annual Program Review Meeting","Compatibility of Gas Turbine Materials with Steam Cooling", Vimal Desai, pp. 291–314, Nov., 1996.
"Proceedings of the Advanced Turbine Systems Annual Program Review Meeting","Bond Strength and Stress Measurements in Thermal Barrier Coatings", Maurice Gell, pp. 315–334, Nov., 1996.
"Proceedings of the Advanced Turbine Systems Annual Program Review Meeting","Advanced Multistage Turbine Blade Aerodynamics, Performance, Cooling and Heat Transfer", Sanford Fleeter, pp. 335–356, Nov., 1996.
"Proceedings of the Advanced Turbine Systems Annual Program Review Meeting","Flow Characteristics of an Intercooler System for Power Generating Gas Turbines", Ajay K. Agrawal, pp. 357–370, Nov., 1996.
"Proceedings of the Advanced Turbine Systems Annual Program Review Meeting","Improved Modeling Techniques for Turbomachinery Flow Fields", B. Lakshiminarayana, pp. 371–392, Nov., 1996.
"Proceedings of the Advanced Turbine Systems Annual Program Review Meeting","Development of an Advanced 3d & Viscous Aerodynamic Design Method for Turbomachine Components in Utility and Industrial Gas Turbine Applications", Thong Q. Dang, pp. 393–406, Nov., 1996.
"Proceedings of the Advanced Turbine Systems Annual Program Review Meeting","Advanced Turbine Cooling, Heat Transfer, and Aerodynamic Studies", Je–Chin Han, pp. 407–426, Nov., 1996.
"Proceeding of the Advanced Turbine Systems Annual Program Review Meeting", "Heat Transfer in a Two Pass Internally Ribbed Turbine Blade Coolant Channel with Vortex Generators", S. Acharya, pp. 427–446.
"Proceeding of the Advanced Turbine Systems Annual Program Review Meeting", "Experimental and Computational Studies of Film Cooling with Compound Angle Injection", R. Goldstein, pp. 447–460, Nov., 1996.
"Proceeding of the Advanced Turbine Systems Annual Program Review Meeting", "Study of Endwall Film Cooling with a Gap Leakage Using a Thermographic Phosphor Fluorescence Imaging System", Mingking K. Chyu, pp. 461–470, Nov., 1996.
"Proceeding of the Advanced Turbine Systems Annual Program Review Meeting", "Steam as a Turbine Blade Coolant: External Side Heat Transfer", Abraham Engeda, pp. 471–482, Nov., 1996.
"Proceeding of the Advanced Turbine Systems Annual Program Review Meeting", "Flow and Heat Transfer in Gas Turbine Disk Cavities Subject to Nonuniform External Pressure Field", Ramendra Roy, pp. 483–498, Nov., 1996.
"Proceeding of the Advanced Turbine Systems Annual Program Review Meeting", "Closed–Loop Mist/Steam Cooling for Advanced Turbine Systems", Ting Wang, pp. 499–512, Nov., 1996.
"Proceeding of the Advanced Turbine Systems Annual Program Review Meeting", "Heat Pipe Turbine Vane Cooling", Langston et al., pp. 513–534, Nov., 1996.
"Proceeding of the Advanced Turbine Systems Annual Program Review Meeting", "EPRI's Combustion Turbine Program: Status and Future Directions", Arthur Cohn, pp. 535,–552 Nov., 1996.
"Proceeding of the Advanced Turbine Systems Annual Program Review Meeting", "ATS Materials Support", Michael Karnitz, pp. 553–576, Nov., 1996.
"Proceeding of the Advanced Turbine Systems Annual Program Review Meeting", "Land Based Turbine Casting Initiative", Boyd A. Mueller, pp. 577–592, Nov., 1996.
"Proceeding of the Advanced Turbine Systems Annual Program Review Meeting", "Turbine Airfoil Manufacturing Technology", Charles S. Kortovich, pp. 593–622, Nov., 1996.
"Proceeding of the Advanced Turbine Systems Annual Program Review Meeting", "Hot Corrosion Testing of TBS's", Norman Bornstein, pp. 633–658, Nov., 1996.
"Proceeding of the Advanced Turbine Systems Annual Program Review Meeting", "Ceramic Stationary Gas Turbine", Mark van Roode, pp. 663–658, Nov., 1996.
"Proceeding of the Advanced Turbine Systems Annual Program Review Meeting", "Western European Status of Ceramics for Gas Turbines", Tibor Bornemisza, pp. 659–670, Nov., 1996.
"Proceeding of the Advanced Turbine Systems Annual Program Review Meeting", "Status of Ceramic Gas Turbines in Russia", Mark van Roode, pp. 671, Nov., 1996.

"Status Report: The U.S. Department of Energy's Advanced Turbine systems Program", facsimile dated Nov. 7, 1996.
"Testing Program Results Validate GE's H Gas Turbine–High Efficiency, Low Cost of Electricity and Low Emissions", Roger Schonewald and Patrick Marolda, (no date available),.
"Testing Program Results Validate GE's H Gas Turbine–High Efficiency, Low Cost of Electricity and Low Emissions", Slide Presentation–working draft, (no date available).
"The Next Step In H...For Low Cost Per Kw–Hour Power Generation", LP–1 PGE '98.
"Utility Advanced Turbine System (ATS) Technology Readiness Testing and Pre–Commercialization Demonstration", Document #486040, Oct. 1–Dec. 31, 1996, Publication Date, Jun. 1, 1997, Report Numbers: DOE/MC/31176—5628,.
"Utility Advanced Turbine System (ATS) Technology Readiness Testing—Phase 3", Document #666274, Oct. 1, 1996–Sep. 30, 1997, Publication Date, Dec. 31, 1997, Report Numbers: DOE/MC/31176–10.
"Utility Advanced Turbine System (ATS) Technology Readiness Testing and Pre–Commercial Demonstration, Phase 3", Document #486029, Oct. 1–Dec. 31, 1995, Publication Date, May 1, 1997, Report Numbers: DOE/MC/31176–5340.
"Utility Advanced Turbine System (ATS) Technology Readiness Testing and Pre–Commerical Demonstration–Phase 3", Document #486132, Apr. 1–Jun. 30, 1976, Publication Date, Dec. 31, 1996, Report Numbers: DOE/MC/31176–5660.
"Utility Advanced Turbine System (ATS) Technology Readiness Testing and Pre–Commercial Demonstration—Phase 3", Document #587906, Jul. 1–Sep. 30, 1995, Publication Date, Dec. 31, 1995, Report Numbers: DOE/MC/31176–5339.
"Utility Advanced Turbine System(ATS) Technology Readiness Testing and Pre–Commercialization Demonstration"Apr. 1–Jun. 30, 1997, Publication Date, Dec. 31, 1997, Report Numbers: DOE/MC/31176–8.
"Utility Advanced Turbine System (ATS) Technology Readiness Testing and Pre–Commercialization Demonstration"Jan. 1–Mar. 31, 1996, DOE/MC/31176—5338.
"Utility Advanced Turbine System (ATS) Technology Readiness Testing: Phase 3R", Document #756552, Apr. 1–Jun. 30, 1999, Publication Date, Sep. 1, 1999, Report Numbers: DE—FC21–95MC31176–23.
"Utility Advanced Turbine System (ATS) Technology Readiness Testing.", Document #656823, Jan. 1–Mar. 31, 1998, Publication Date, Aug. 1, 1998, Report Numbers: DOE/MC/31176–17.
"Utlity Advanced Turbine Systems (ATS) Technology Readiness Testing and Pre–Commercial Demonstration", Annual Technical Progress Report, Reporting Period: Jul. 1, 1995–Sep. 30, 1996.
"Utility Advanced Turbine Systems (ATS) Technology Readiness Testing", Phase 3R, Annual Technical Progress Report, Reporting Period: Oct. 1, 1997–Sep. 30, 1998.
"Utility Advanced Turbine Systems (ATS) Technology Readiness Testing", Document #750405, Oct. 1–Dec. 30, 1998, Publication Date: May 1, 1999, Report Numbers: DE–FC21–95MC31176–20.
"Utility Advanced Turbine Systems (ATS) Technology Readiness Testing", Document #1348, Apr. 1–Jun. 29, 1998, Publication Date Oct. 29, 1998, Report NUmbers DE–FC21–95MC31176—18.
"Utility Advanced Turbine Systems (ATS) Technology Readiness Testing–Phase 3", Annual Technical Progress Report, Reporting Period: Oct. 1, 1996–Sep. 30, 1997.
"Utility Advanced Turbine Systems (ATS) Technology Readiness Testing and Pre–Commercial Demonstration", Quarterly Report, Jan. 1–Mar. 31, 1997, Document #666275, Report Numbers: DOE/MC/31176–07.
"Proceedings of the 1997 Advanced Turbine Systems", Annual Program Review Meeting, Oct. 28–29, 1997.

* cited by examiner

RECESSED IMPINGEMENT INSERT METERING PLATE FOR GAS TURBINE NOZZLES

FEDERAL RESEARCH STATEMENT

This invention was made with Government support under Contract No. DE-FC21-95MC31176 awarded by the Department of Energy. The Government has certain rights in this invention.

BACKGROUND OF INVENTION

The present invention relates generally to cooling gas turbines, for example, for electrical power generation and, more particularly, to the provision of a metering plate in an impingement insert for metering flow into that impingement insert.

The traditional approach for cooling turbine blades and nozzles is to use high pressure cooling air extracted from a source, such as from the intermediate and last stages of the turbine compressor. A series of internal flow passages are typically used to achieve the desired mass flow objectives for cooling the turbine blades. External piping is generally used to supply air to the nozzles, with the air typically exiting into the hot gas stream of the turbine to provide air film cooling of the nozzle surface.

In advanced gas turbine designs, it was recognized that the temperature of the hot gas flowing past the turbine components could be higher than the melting temperature of the metal. It was therefore necessary to develop a cooling scheme that more assuredly protects the hot gas path components during operation. Steam has been demonstrated to be a preferred cooling media for cooling gas turbine nozzles (stator vanes), particularly for combined-cycle plants. See, for example, U.S. Pat. No. 5,253,976, the disclosure of which is incorporated herein by this reference. However, because steam has a higher heat capacity than the combustion gas, it is inefficient to allow the coolant steam to mix with the hot gas stream. Consequently, it is desirable to maintain cooling steam inside the hot gas path components in a closed circuit. Certain areas of the components of the hot gas path, however, cannot practically be cooled with steam in a closed circuit. For example, the relatively thin structure of the trailing edges of the nozzle vanes effectively precludes steam cooling of those edges. Therefore, air cooling may be provided in the trailing edges of nozzle vanes. For a complete description of the steam cooled nozzles with air cooling along the trailing edge, reference is made to U.S. Pat. No. 5,634,766, the disclosure of which is incorporated herein by reference.

In turbine nozzles there are typically impingement inserts disposed inside the nozzle cavities to augment heat transfer coefficients and, therefore, increase cooling of the airfoil walls. Metering plates may be used in an impingement cooled multiple cavity nozzle to balance the total cooling system overall flow distribution. The use of a metering plate in an impingement insert creates a flow disruption that causes reduced total pressure in the area just below the metering plate and therefore meters the flow into that particular impingement insert. A typical metering plate has one or more orifice holes to control the flow into the insert. Conventionally, the metering plate is placed on top of the insert inlet prior to or during assembly into the nozzle. Because of the reduced total pressure in the area below the metering plate, the metering plate reduces the pre-impingement pressure in the insert thereby reducing ballooning stresses in the insert.

SUMMARY OF INVENTION

The present invention provides a cooling system for cooling the hot gas components of a nozzle stage of a gas turbine, in which closed circuit steam or air cooling and/or open circuit air cooling systems may be employed. In the closed circuit system, a plurality of nozzle vane segments are provided, each of which comprises one or more nozzle vanes extending between inner and outer walls. The vanes have a plurality of cavities in communication with compartments in the outer and inner walls for flowing cooling media in a closed circuit for cooling the outer and inner walls and the vanes per se. This closed circuit cooling system is substantially structurally similar to the steam cooling system described and illustrated in the prior referenced U.S. Pat. No. 5,634,766, with certain exceptions as noted below. Thus, cooling media is provided to a plenum in the outer wall of the segment for distribution therein and passage through impingement openings in a plate for impingement cooling of the outer wall surface of the segment. The spent impingement cooling media flows into leading edge and aft cavities extending radially through the vane. Return intermediate cooling cavities extend radially and lie between the leading edge and aft cavities. A separate trailing edge cavity may also be provided.

The cooling media that flows through the leading edge and aft cavities flows into a plenum in the inner wall and through impingement openings in an impingement plate for impingement cooling of the inner wall of the segment. The spent impingement cooling media then flows through the intermediate return cavities for further cooling of the vane.

Impingement cooling is also provided in the leading and aft cavities of the nozzle vane, as well as in the intermediate, return cavities of the vane. More specifically, impingement inserts are disposed inside the nozzle cavities to augment heat transfer coefficients and, therefore, increase cooling of the airfoil walls. The inserts in the leading and aft cavities comprise sleeves having a collar at their inlet ends for connection with integrally cast flanges in the outer wall of the cavities and extend through the cavities spaced from the walls thereof. These inserts have impingement holes in opposition to the walls of the cavity whereby cooling media, e.g. steam, flowing into the inserts flows outwardly through the impingement holes for impingement cooling of the vane walls. Return or exit channels may be provided along the inserts for channeling the spent impingement cooling media. Similarly, inserts in the return intermediate cavities have impingement openings for flowing impingement cooling medium against the side walls of the vane. These inserts also may have return or exit channels for collecting the spent impingement cooling media and conducting it to the cooling media outlet.

Typically, nozzles do not have metering plates as a part of the impingement insert design. Of the known designs using inserted metering plates, the metering plate is placed on and connected to the top of the insert. As used herein, 'top of the insert' refers to the entrance end or inlet end of the insert with respect to the direction of coolant flow therethrough. Thus, intermediate inserts through which coolant flow flows radially outwardly would have a metering plate, if provided, disposed at a radially inner end thereof.

While metering plates are considered generally effective to balance cooling flow to different cavities of the nozzle as required and to reduce ballooning stresses on the insert, that is not to say that improvement thereof cannot be made. Indeed, in an embodiment of the invention, by relocating the metering plate from its conventional top end placement, significant improvements to the flow distribution and insert assembly can be achieved.

Thus, in an embodiment of the invention, an impingement insert metering plate is provided that improves the mechanical robustness of the insert assembly, improves the assembly of the insert to the nozzle and improves the manufacturing assembly of the insert.

Accordingly, the invention is embodied in an impingement insert sleeve for being disposed in a coolant cavity defined through a stator vane, the insert having a generally open inlet end and first and second diametrically opposed, perforated side walls. A metering plate having at least one opening defined therethrough for coolant flow is mounted to the side walls to generally transverse a longitudinal axis of the insert, downstream from said inlet end.

The invention is further embodied in a turbine vane segment, comprising inner and outer walls spaced from one another; a vane extending between the inner and outer walls and having leading and trailing edges, the vane including a plurality of discrete cavities between the leading and trailing edges and extending lengthwise of the vane for flowing a cooling medium; an insert sleeve within one the cavity and spaced from interior wall surfaces thereof, the insert sleeve having an inlet end through which cooling medium flows into the insert sleeve, the insert sleeve having a plurality of openings therethrough for flowing the cooling medium through the openings into the space between the sleeve and the interior wall surfaces for impingement against the interior wall surface of the vane; and a metering plate having at least one opening for cooling medium flow defined therethrough, the metering plate being mounted to the insert sleeve so as to substantially traverse a flow path defined therethrough, the metering plate being spaced from the inlet end of the insert sleeve.

BRIEF DESCRIPTION OF DRAWINGS

These, as well as other objects and advantages of this invention, will be more completely understood and appreciated by careful study of the following more detailed description of the presently preferred exemplary embodiments of the invention taken in conjunction with the accompanying drawings, in which.

DETAILED DESCRIPTION

As discussed previously, the present invention relates in particular to cooling circuits for the first stage nozzles of a turbine, reference being made to the previously identified patents for disclosures of various other aspects of the turbine, its construction and methods of operation.

Figure 1:
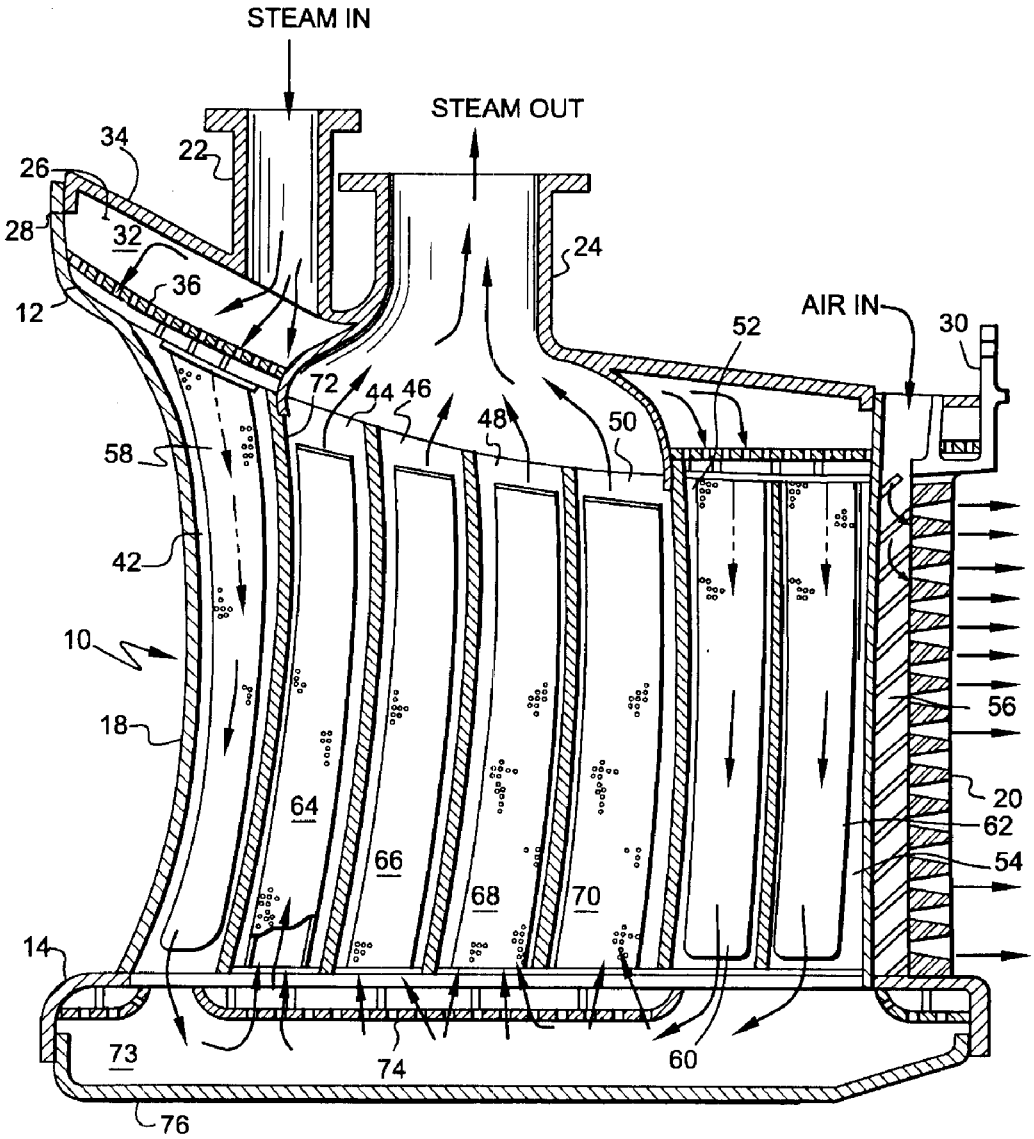
FIG. 1 is a schematic, cross-sectional view of an exemplary first stage nozzle vane.

Referring now to FIG. 1, there is schematically illustrated in cross-section a vane 10 comprising one of the plurality of circumferentially arranged segments of the first stage nozzle. It will be appreciated that the segments are connected one to the other to form an annular array of segments defining the hot gas path through the first stage nozzle of the turbine. Each segment includes radially spaced outer and inner walls 12 and 14, respectively, with one or more nozzle vanes 10 extending between the outer and inner walls. The segments are supported about the inner shell of the turbine (not shown) with adjoining segments being sealed one to the other. It will therefore be appreciated that the outer and inner walls and the vanes extending therebetween are wholly supported by the inner shell of the turbine and are removable with the inner shell halves of the turbine upon removal of the outer shell as set forth in U.S. Pat. No. 5,685,693. For purposes of this description, the vane 10 will be described as forming the sole vane of a segment.

As shown in a schematic illustration of FIG. 1, the vane has a leading edge 18, a trailing edge 20, an outer wall 12 and an inner wall 14. The outer wall includes outer side rails 26, a leading rail 28 and a trailing rail 30 that define a plenum 32 with outer cover plate 34. An impingement plate 36 is disposed generally in parallel to the outer wall for impingement cooling of the outer wall. It is to be noted that the terms outwardly and inwardly or outer and inner as used herein refer to the generally radial direction.

Figure 2:
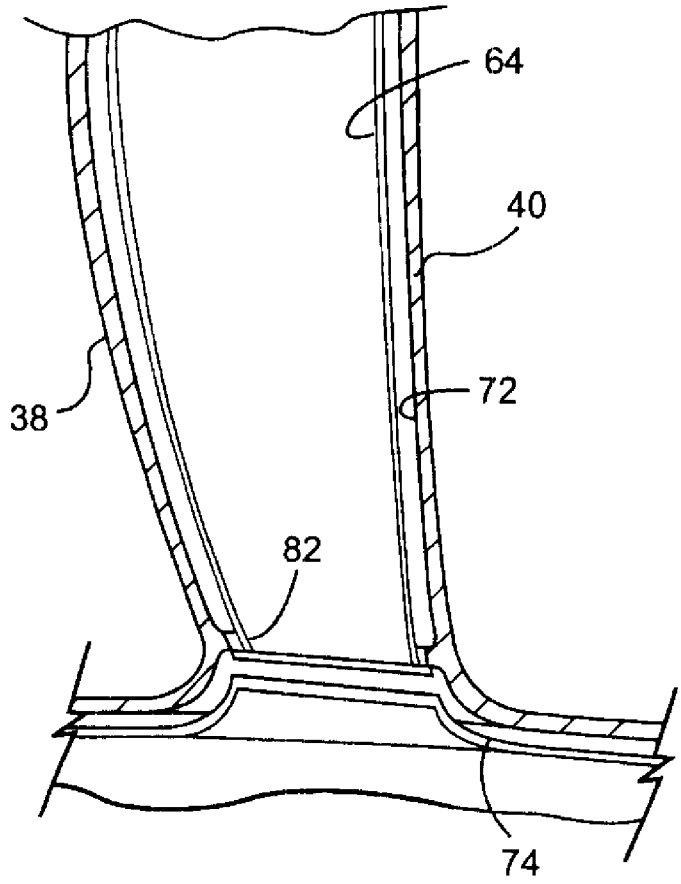
FIG. 2 is a schematic cross sectional view showing an impingement insert disposed within a nozzle cavity and having a metering plate connected in a conventional manner to an inlet end thereof.
Figure 3:
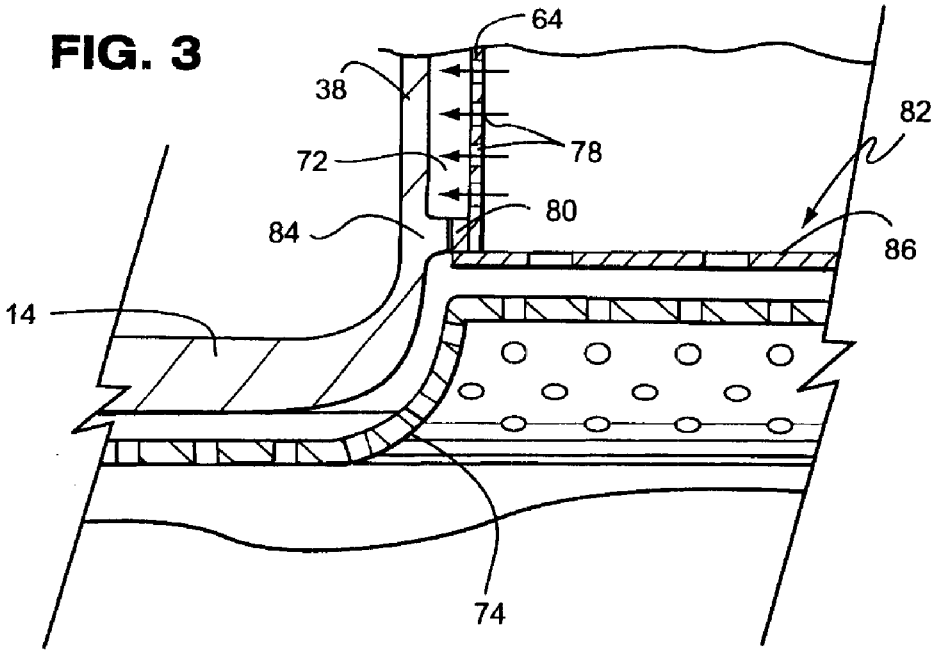
FIG. 3 is a schematic cross-sectional view illustrating a conventional end connection of the metering plate.

In this example, the nozzle vane has a plurality of cavities, for example, a leading edge cavity 42, aft cavities 52, 54 and a plurality of intermediate return cavities 44, 46, 48, 50. Thus, the cooling medium, such as steam flows in through a steam inlet 22, through impingement plate 36 to impingement cool the outer wall 12 and then flows radially inwardly through, e.g., the leading edge cavity 42 and aft cavities 52, 54. The post impingement cooling media flows into a plenum 73 defined by the inner wall 14 and a lower cover plate 76. Radially inwardly of the inner wall is an impingement plate 74 (FIGS. 2–3). As a consequence, it will be appreciated that spent impingement cooling steam flows through the impingement openings of the impingement plate 74 for impingement cooling of the inner wall 14. The spent cooling medium then flows towards the openings of the intermediate cavities for return flow to a steam outlet 24.

In FIGS. 2 and 3, a single insert disposed in a single cavity is illustrated. By way of non-limiting example, insert 64 disposed in cavity 44 is schematically shown. In a conventional manner, the insert sleeve is disposed in the cavity in spaced relation from the side walls 38, 40 and partition wall(s) 72 defining the respective cavity. The impingement openings 78 lie on opposite sides of the sleeves for flowing the cooling medium, e.g., steam, from within the insert sleeve through the impingement openings for impingement cooling of the side walls of the vane, generally as discussed above. The spent cooling steam then flows through the gaps between the insert sleeve and the walls of the cavity to the outlet 24 for return to the coolant supply.

As illustrated in FIGS. 2 and 3, to secure the impingement insert in the nozzle cavity, an insert collar 80 is conventionally provided peripherally of the opening at the inlet end 82 of the impingement insert at the interface of the impingement insert and the flash rib 84 of the nozzle airfoil wall. The insert collar 80 is secured to the flash rib 84 by a braised or welded connection. As mentioned above, typically nozzles do not have a metering plate as a part of the impingement insert design. Of the known designs using insert metering plates, the metering plate 86 is provided on the inlet end 82 of the insert. This is either done when the insert 64 is assembled, or as a part of the nozzle to insert assembly. Thus, the metering plate 86 is conventionally secured to the insert collar 80 at the inlet end 82 of the impingement insert 64.

Figure 4:
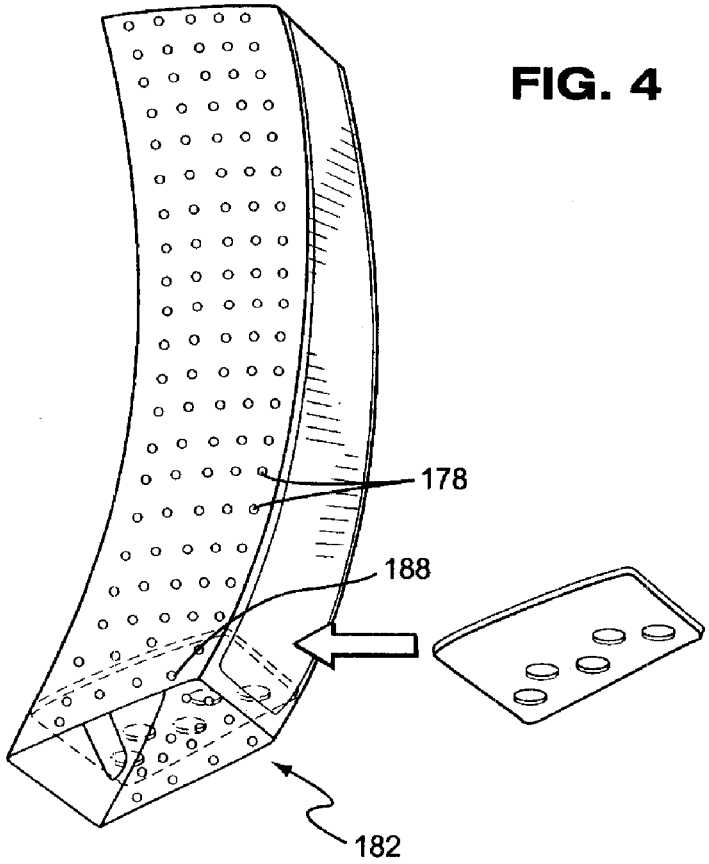
FIG. 4 is a schematic perspective view of the assembly of a recessed metering plate to an insert as an embodiment of the invention.
Figure 5:
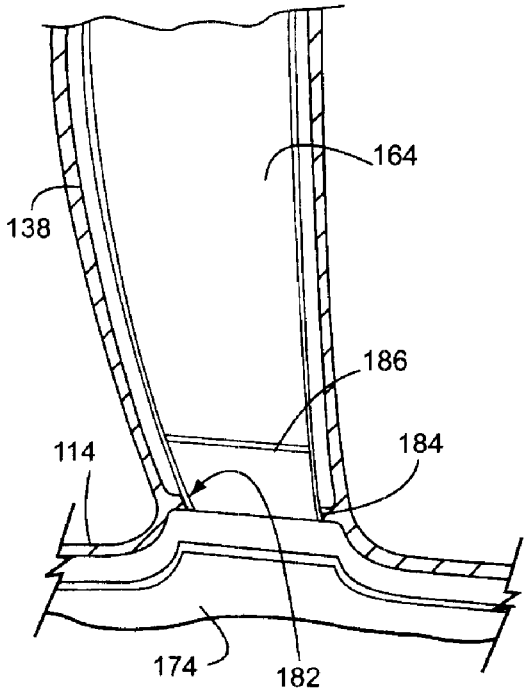
FIG. 5 is a schematic cross sectional view showing an impingement insert disposed within a nozzle cavity and having a recessed metering plate assembly embodying the invention connected thereto.
Figure 6:
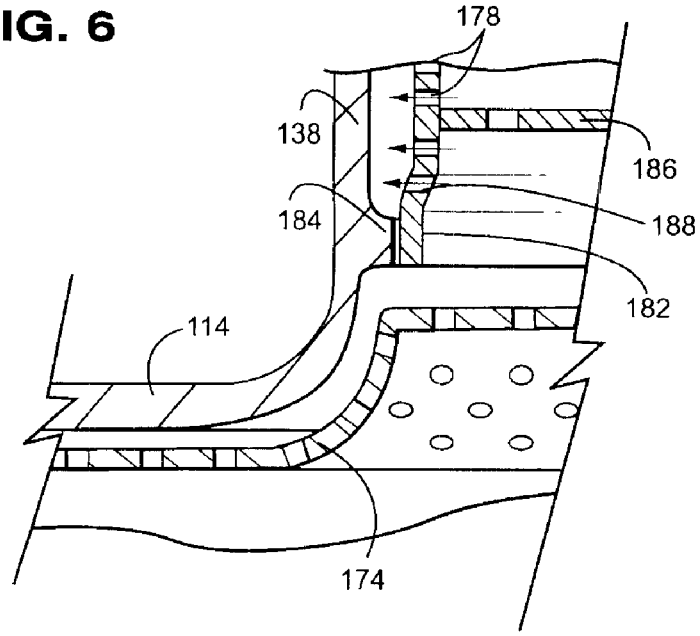
FIG. 6 is a schematic cross-sectional view illustrating the insert/nozzle connection in an embodiment of the invention.

An embodiment of the invention is illustrated in FIGS. 4, 5 and 6. To facilitate an understanding of the illustrated assembly, reference numbers generally corresponding to those used above and in FIGS. 1–3 are used in FIGS. 4–6, but incremented by 100. In the embodiment illustrated in FIGS. 4–6, the metering plate 186 is placed below, that is downstream of the impingement insert inlet end 182. More specifically, lower than or downstream from the first row 188 of impingement insert cooling holes 178. Thus, the metering plate 186 is recessed at least to below the first row of impingement insert cooling holes 188. At least one, and generally a plurality of openings 190 for cooling media flow are defined through the metering plate 186.

The use of a recessed metering plate 186 as illustrated by way of example in FIGS. 4–6 reduces the possibility of restricting flow to the metering plate due to interference with additional nozzle parts such as the inner wall impingement plate 174. Furthermore, flow distribution is improved because the variability in flow between the impingement plate 174 above the insert and the insert itself would be significantly reduced by the elimination of the metering plate placement on top of the insert 164.

Placing the metering plate as illustrated in FIGS. 4–6, spaced from the insert inlet 182, has the advantage of reducing ballooning stresses (internal pressure) within the insert. Indeed, due to the mechanical strength of the metering plate 186 and also due to the reduced pre-impingement pressure caused by the total pressure loss across the metering plate, the ballooning of the insert walls is reduced.

In addition, the connection at assembly of the insert 164 to the metering plate 186 forms a more significant structure to hold the form of the insert 164 during subsequent handling and assembly. This improves the profile of the insert thereby improving the cooling flow to the nozzle.

The placement of the metering plate further away from the impingement insert inlet 182 also allows for a more flexible insert attachment at that inlet. This is a very significant improvement to the manufacturing assembly. The conventional relatively rigid inlet end of the insert, due to the presence of the insert collar 80 requires very precise machining to enable a good connection joint (braise or weld) to the flash rib 84. The more flexible inlet end 182 enabled by the invention, with the spacing of the metering plate from the inlet end, and the consequent elimination of the insert collar 82 at the inlet end is an important factor in improving the connection as the insert can, to a varying degree, be formed to the opening.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An impingement insert sleeve for being disposed in a coolant cavity defined through a stator vane, having a generally open inlet end and first and second diametrically opposed, perforated side walls and having a metering plate mounted to said side walls and disposed so as to be generally transverse a longitudinal axis thereof downstream from said inlet end, said metering plate having at least one opening defined therethrough for coolant flow.

2. An impingement insert sleeve as in claim 1, wherein there are a plurality of flow openings defined through said metering plate.

3. An impingement insert sleeve as in claim 1, wherein said metering plate is disposed generally perpendicular to said longitudinal axis.

4. An impingement insert sleeve as in claim 1, wherein said metering plate is disposed downstream of at least a first of said plurality of openings defined through said insert sleeve.

5. An impingement insert sleeve as in claim 1, wherein said plurality of openings are defined as a plurality of rows of openings, and said metering plate is disposed downstream of a first one of said rows of openings.

6. A turbine vane segment, comprising:

inner and outer walls spaced from one another;

a vane extending between said inner and outer walls and having leading and trailing edges, said vane including a plurality of discrete cavities between the leading and trailing edges and extending lengthwise of said vane for flowing a cooling medium;

an insert sleeve within one said cavity and spaced from interior wall surfaces thereof, said insert sleeve having an inlet end through which cooling medium flows into said insert sleeve, said insert sleeve having a plurality of openings therethrough for flowing the cooling medium through said openings into said space between said sleeve and said interior wall surfaces for impingement against said interior wall surface of said vane; and a metering plate having at least one opening for cooling medium flow defined therethrough, said metering plate being mounted to said insert sleeve so as to substantially traverse a flow path defined therethrough, said metering plate being spaced from said inlet end of said insert sleeve.

7. A turbine vane segment as in claim 6, wherein said metering plate is disposed downstream of at least a first of said plurality of openings defined through said insert sleeve.

8. A turbine vane segment as in claim 6, wherein said plurality of openings are defined as a plurality of rows of openings, and said metering plate is disposed downstream of a first one of said rows of openings.

9. A turbine vane segment as in claim 6, wherein there are a plurality of flow openings defined through said metering plate.

10. A turbine vane segment as in claim 6, further comprising a flash rib defined about at least a portion of the periphery of said vane adjacent said inlet end of said insert sleeve, said insert sleeve being secured at said inlet end thereof to said flash rib.

11. A turbine vane segment as in claim 6, wherein said impingement holes are defined in first and second walls of the insert sleeve that face, respectively, pressure end suction sides of the vane.

12. A turbine vane segment as in claim 6, wherein said insert is disposed in an intermediate cavity of said vane through which cooling medium flows from said inner wall towards said outer wall.

* * * * *